US008813665B2

(12) United States Patent
Ulgen

(10) Patent No.: US 8,813,665 B2
(45) Date of Patent: Aug. 26, 2014

(54) DUAL-RUDDER MECHANISM FOR PERFORMANCE SAILBOATS

(75) Inventor: Mehmet Nevres Ulgen, Istanbul (TR)

(73) Assignee: Mehmet Nevres Ulgen, Istanbul (TR)

( * ) Notice: Subject to any disclaimer, the term of this patent is extended or adjusted under 35 U.S.C. 154(b) by 221 days.

(21) Appl. No.: 13/334,738

(22) Filed: Dec. 22, 2011

(65) Prior Publication Data

US 2013/0160690 A1 Jun. 27, 2013

(51) Int. Cl.
*B63H 25/06* (2006.01)

(52) U.S. Cl.
USPC ..... 114/163

(58) Field of Classification Search
CPC ..... B63H 2025/066
USPC ..... 114/163
See application file for complete search history.

(56) References Cited

U.S. PATENT DOCUMENTS 4,027,614 A * 6/1977 Jones ..... 114/163
4,444,143 A * 4/1984 Tattersall et al. ..... 114/67 A

* cited by examiner

*Primary Examiner* — Stephen Avila
*Assistant Examiner* — Andrew Polay
(74) *Attorney, Agent, or Firm* — Vidas, Arrett & Steinkraus, P.A.

(57) ABSTRACT

A dual-rudder control mechanism suitable for use in the sailboats (1), comprising an extendable pivot (8) having each end a respective rudder, mechanism (20) for extending the pivot (8) length, and a control mechanism being responsive to tilting angle of the sailboat (1), and activating or deactivating the mechanism (20) for extending the pivot length in response to the threshold tilting angle of the sailboat body.

4 Claims, 6 Drawing Sheets

DUAL-RUDDER MECHANISM FOR PERFORMANCE SAILBOATS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a rudder control mechanism for double-rudder sailboats. This rudder control mechanism comprises a structure preventing water resistance of a sailboat when the rudder surface on the higher part rotates in the sea while maneuvering in the cases that the sailboat tilts angularly in the sailing position, and therefore preventing the speed of the boat from decreasing.

In order for their capacity of maneuvering to be high, performance sailboats are equipped with dual-rudders that are oblique in plus and minus proportions, the pivots of which are adjusted to 90 degree steepness. Such sailboats list with the effect of the wind and in the meanwhile if it is desired to maneuver at the side to which the boat tilts (in other words shifting from luff to broad reach or from broad reach to full sail), the rudder that stays on the higher part after the boat has tilted generates unfunctional resistance. In other words, as the said rudder that stayed on the higher part operates in parallel with the pivot by means of which it is connected to the functional rudder which is close to the steep position to the water, which has been designed to be functional, and when it rotates because of the said position which is at higher plus degrees to the steep position, the broad surface of the said rudder generates a resistance, a breaking effect in the waters flowing towards to opposite direction of the boat movement.

Such resistance causes, especially in the sailboat races, the boats to lose speed while turning around the floating flag and therefore to deviate from the direction of rotation, which is an undesired outcome. In the art, many dual-rudder control mechanisms have been proposed, however even if not all, most of them offer solutions for increasing the maneuvering capability of the boats (sailing or not) when they are under normal sail. For examples, the documents U.S. Pat. No. 3,147,730, U.S. Pat. No. 4,082,053, U.S. Pat. No. 4,444,145, U.S. Pat. No. 5,445,100, the entire contents of which is incorporated herein by reference, can be considered as the examples for synchronous or asynchronous dual-rudder control mechanisms. However, none of the mechanisms that are disclosed in these documents comprise a solution for preventing the rudder from dragging in the case that a tilted sailboat maneuvers.

BRIEF SUMMARY OF THE INVENTION

An object of the present invention is to eliminate the speed loss and direction deviations resulting from the water resistance emerged when the pivot angle of the rudder on the higher part is spoilt during the maneuvering in the dual-rudder performance sailboats.

The present invention relates to a dual-rudder control mechanism suitable to be used in the sailboats. This mechanism comprises an extendable pivot having each end a respective rudder, mechanism for extending the pivot, a control mechanism being responsive to tilting angle of the sailboat, and activating or deactivating the mechanism for extending the pivot in response to a threshold tilting angle of the sailboat.

According to a preferred embodiment of the present invention, the pivot, to both ends of which the rudders are connected, is a telescopic pivot. In other words, the pivot is composed of coaxial pivots, each of which can move all through the other's axis. The mechanism for enabling one of these pivots to move all through the other's axis and therefore for extending the pivot length are preferably solenoid actuators. The number of these pivots are one for each rudder, and two in total; and when the boat reaches to a certain threshold tilting angle, the actuators become activated and open the lock locking these pivots to each other in order to enable the pivot to make a telescopic movement, and lock it again when the tilting angle goes under the threshold degree.

The control mechanism for moving the mechanism for extending the pivot length preferably comprises an inclination sensor and a control circuit. The signals generated by the said inclination sensor are controlled by the control circuit. When it reaches to a certain threshold inclination, the control circuit generates the command signal necessary to actuate the solenoid actuators.

BRIEF DESCRIPTION OF THE SEVERAL VIEWS OF THE DRAWINGS

In order for the present invention to be structured and its advantages to be understood well together with its accompanying elements, it should be evaluated together with the figures that are described below.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figures 1, 1A:
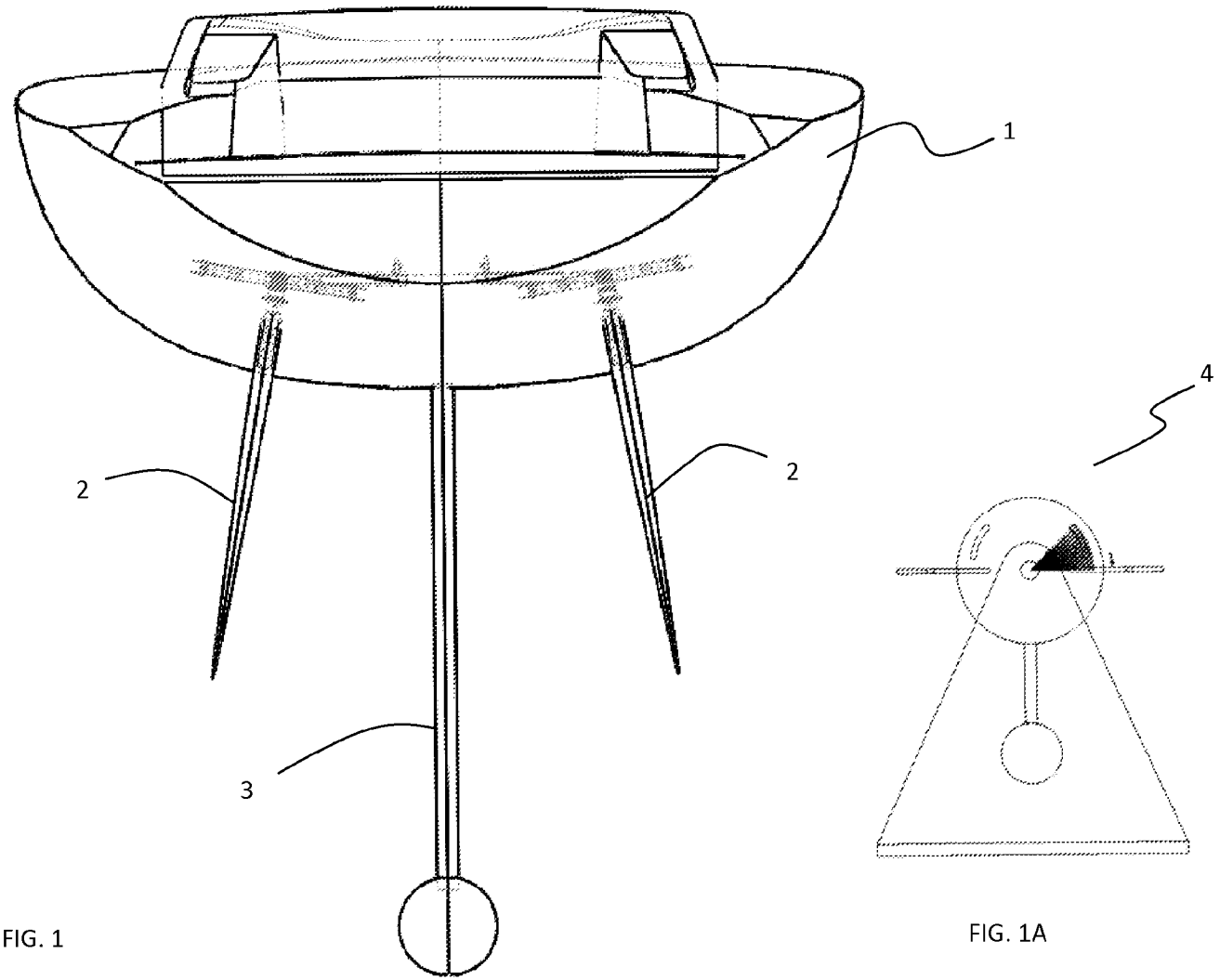
FIG. 1 is the rear view of the boat together with the dual-rudder control mechanism according to the present invention.
FIG. 1A is the view of a pendulum inclinometer.

As it is shown in FIG. 1, the sailboat (1) comprising preferably a centerboard (3) (for the sake of simplicity, the sailing has not been shown) comprises two rudders (2) extending towards the bottom part of the boat as mutual to the vertical symmetry axis of the boat (1). The rudders (2) can extend slightly outwards from the vertical symmetry axis to downwards as it is shown in FIG. 1, but also if desired, they can extend in a total vertical direction.

Figure 2:
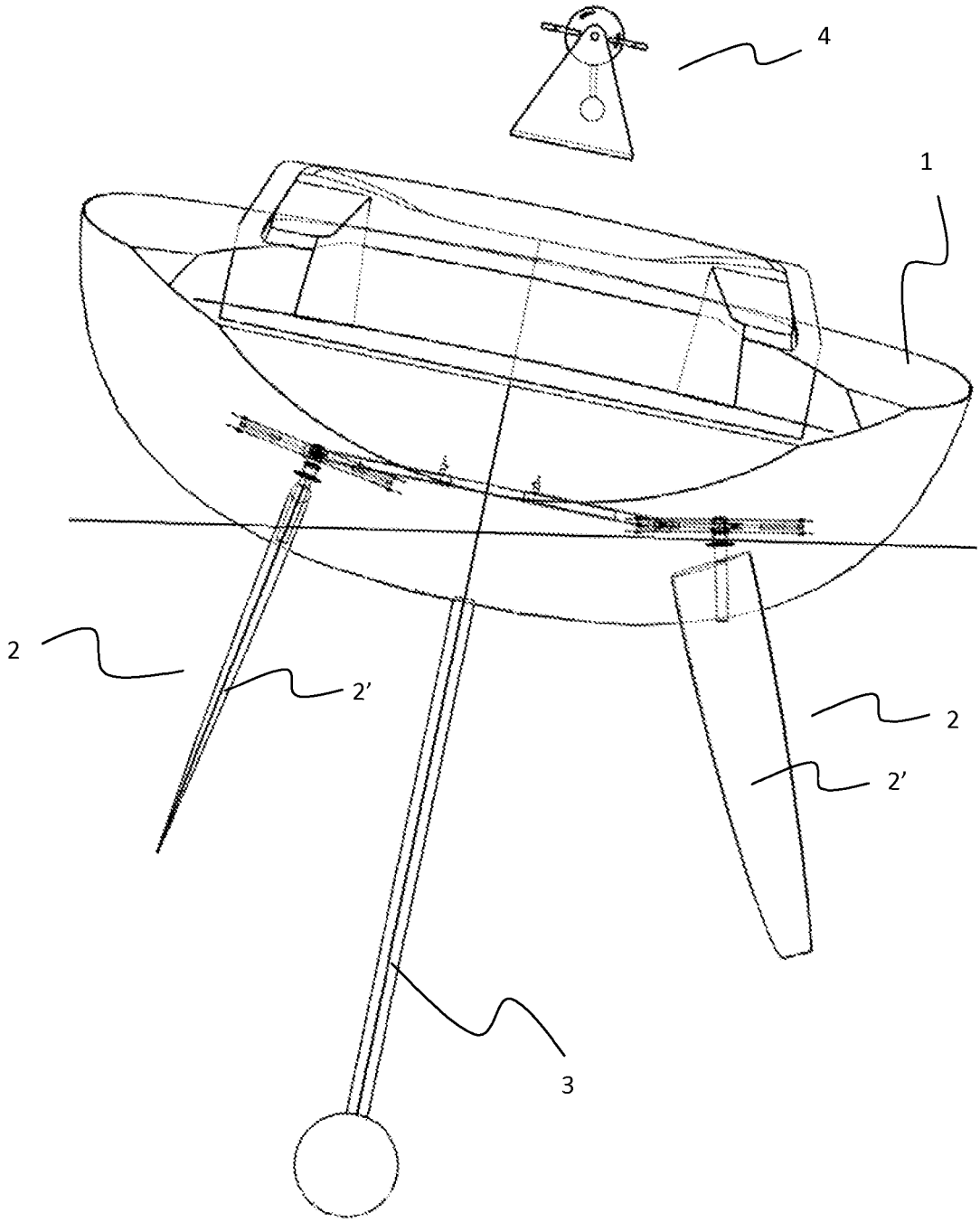
FIG. 2 is the rear view of the boat when it has maneuvered to right direction in tilted position and the view of the dual-rudder control mechanism according to the present invention.

The boat position in FIG. 2 shows a typical situation when the dual-rudder control mechanism according to present invention is put into force. Here, the boat (1) tilts to the right with the wind coming from the left, and when making a maneuver in the meanwhile (when the rudder on the right is turned to right), the surface of the rudder (2') on the left does not resist against the water thanks to the dual-rudder control mechanism according to the present invention, in other words the said rudder on the left (2) rotates by splitting the water by means of the below-described mechanism.

Figure 3:
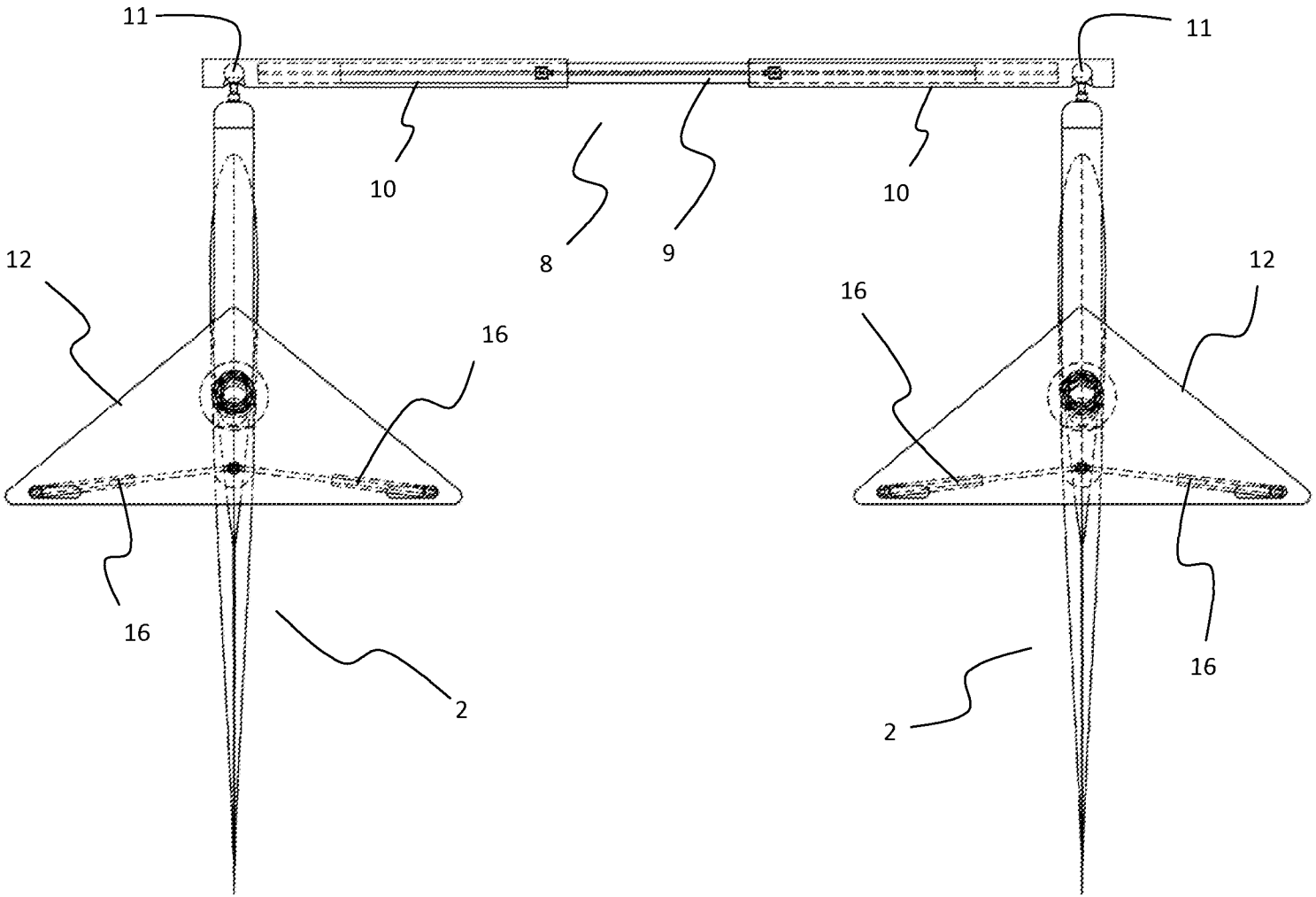
FIG. 3 is the top view of the dual-rudder control mechanism according to the present invention.

As it is shown in FIG. 3, the dual-rudder control mechanism according to the present invention comprises a pivot (8) which is connected to both ends of each rudder (2) and which can be extended by means of a preferably telescopic arrangement. The said pivot (8) comprises an outer pivot (10) for both of the end parts and an inner pivot (9) co-axially mounted to the outer pivots (10) and the inner pivot (9) can move through their axes. If desired, the places of the inner and outer pivots can be changed, in other words the pivots that are inside can be on the both ends and the pivots that are outside can be in the middle.

Throughout this description, the term "extending" or "extendable" used to express that the pivot (8) has a variable length should be understood that the pivot is also retractable. Therefore the pivot (8) is extendable and retractable.

It is provided with the help of the mechanism (20) for extending the pivot length driving a pin (22) that can go into the pin holes (23) that are opened in the radial direction to the pivots (9,10) that the inner pivot (9) moves inside the outer pivots (10) and that the pivot (8) is extended. The said mechanism (20) is a solenoid actuator according to the preferred embodiment of the invention. Under the normal cruising conditions, in other words when the boat (1) does not reach to a certain threshold tilting angle (for example as in FIG. 1), the pins (22) are in a condition that they are inserted into the pin holes (23) that are opened in a radial direction to the inner pivots (9) and outer pivots (10). Therefore it is impossible for the inner pivot (9) to make a telescopic movement. The rudder of the boat (1) is connected to the inner pivot (9) by means of a connection rod (not shown in the figures) from the center. In such a case, if a maneuver is made, both of the rudders (2) synchronously rotate to the right or left direction to the same extent. The pin holes (23) are located at the ends of the outer pivots (10) that are close to the inner pivot (9) and the inner pivot (9) has two pin holes (23) corresponding to the holes on the outer pivots.

When the boat (1) tilts, if the angle that the boat (1) makes with the horizontal direction (horizon line) reaches to a certain threshold degree, the pivot part to which the rudder on the higher part compared to the horizontal one is connected starts to make a telescopic movement. For that reason the dual-rudder control mechanism comprises an inclination sensor. When the threshold tilting angle is reached, the inclination sensor transmits a signal to the solenoid actuator (20) on the pivot part, which the rudder on the higher part is connected to, by means of a control circuit 24, and provides the pin (22) to be pushed upwards (to be out of the pin holes (23)) by means of a spring (21) in the actuator (20). Therefore, the length of the pin to which the rudder on the higher part is connected can extend. In other words, if a maneuver is made in such a case, the rudders (2) do not rotate synchronously. For instance, if the boat maneuvers to the right when the threshold tilting angle is reached as in FIG. 2, the rudder on the higher part (left) becomes independent form the lower rudder (right), and then the rudder rotates automatically to the maneuvering direction of the boat by splitting the water, because the rudder which has become free when the left pin (22) goes out of the hole (23) gets into a harmony with the flow of the water and rotates automatically to the edge direction.

The tilting angle of the boat can also be sensed by means of a mechanical sensor instead of an inclination sensor. A pendulum inclinometer (4) as in FIG. 1A can be used for this purpose.

Figure 4:
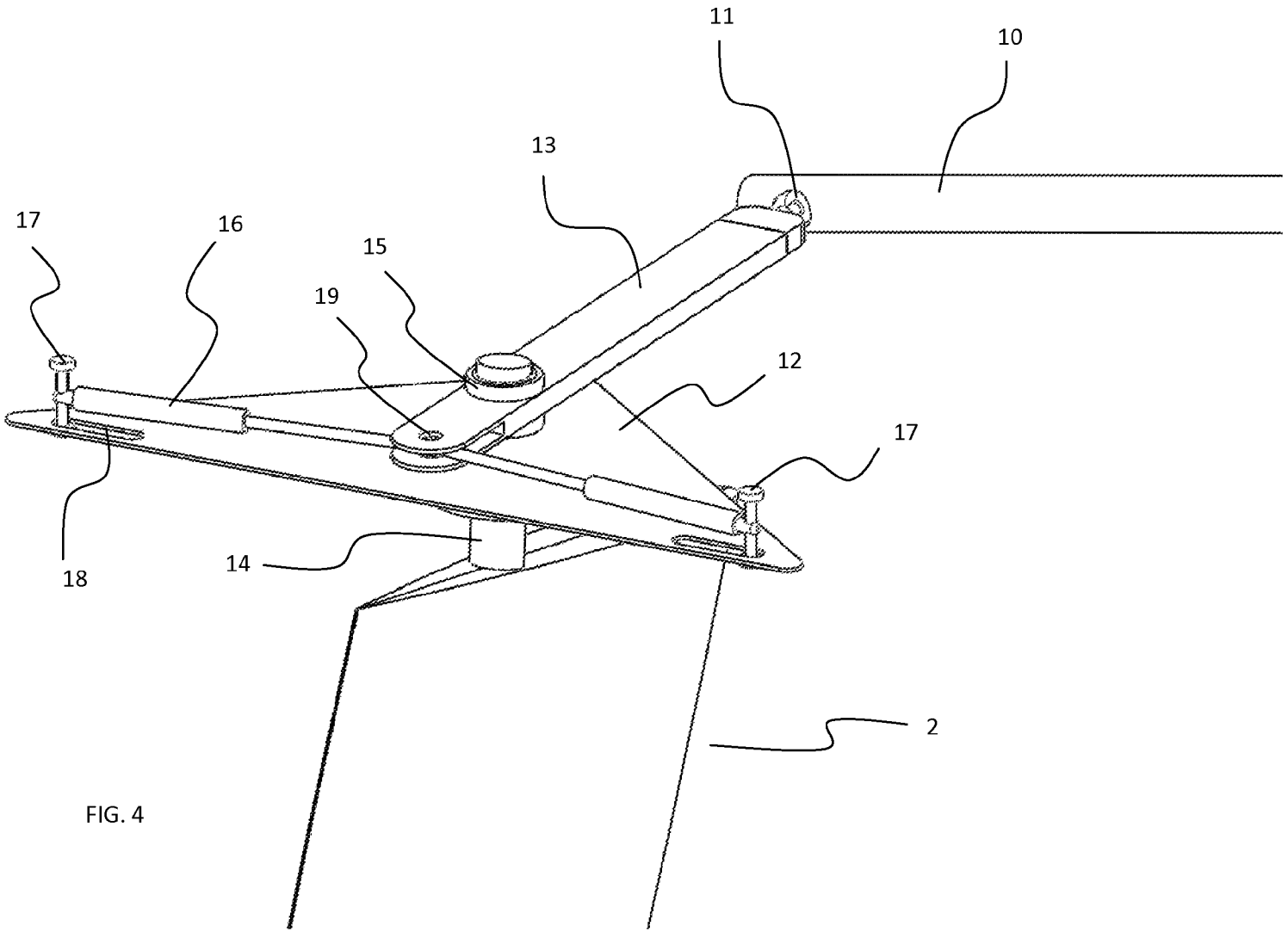
FIG. 4 is the detailed view of the rudder pivot connection in the dual-rudder control mechanism according to the present invention.
Figure 5:
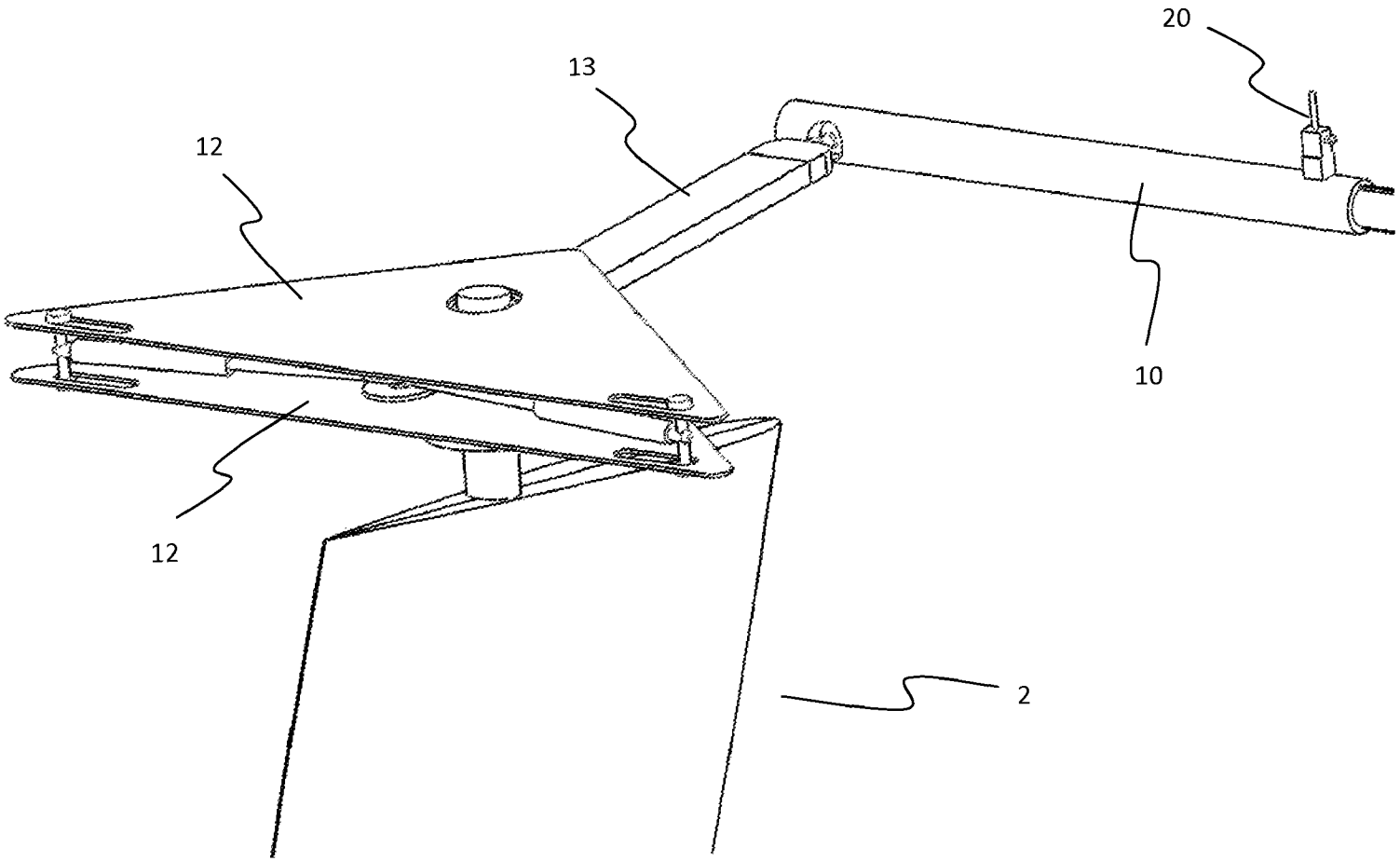
FIG. 5 is the detailed view of the rudder pivot connection in the dual-rudder control mechanism according to the present invention together with the rudder plate.
Figure 6:
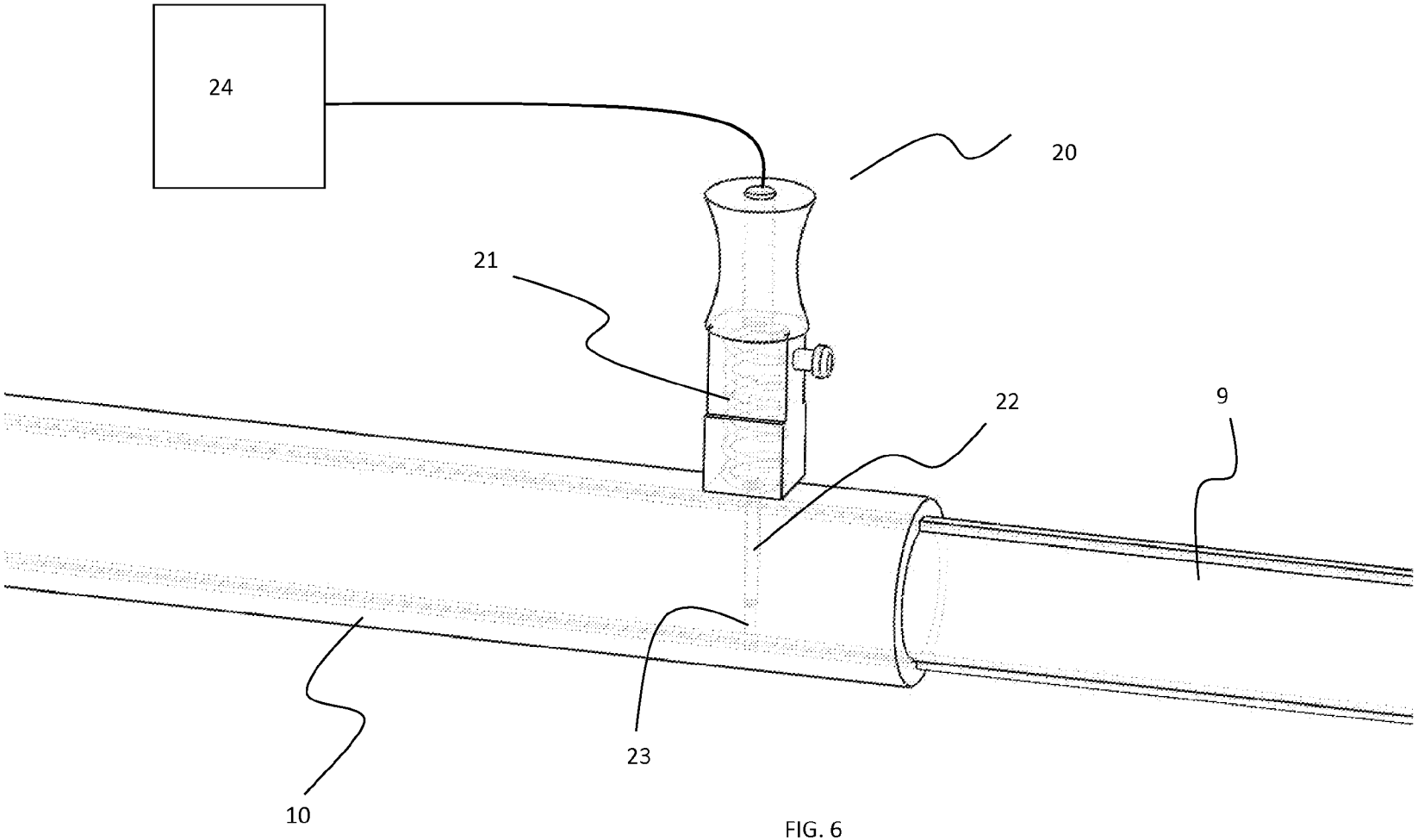
FIG. 6 is the view of the mechanism for extending the pivot length.

In FIG. 4, the detailed view of the rudder pivot connection in the dual-rudder control mechanism according to the present invention is shown. Each rudder (2) is connected to each end part of the pivot (8) by means of a pivot connection arm (13) and a rudder connection pivot (14). Each pivot connection arm (13) is connected to the end parts of the pivot (8) radially by means of preferably spherical bearings 11. At the other end part of each pivot connection arm (13) are located rudder connection arms (14) extending downwards from these arms. The connection between the pivot connection arms (13) and the rudder connection arms (14) is rigid, and if desired the pivot connection arm and the rudder connection pivot can be produced as one-piece.

Each rudder connection pivot (14) is borne to the rudder plates (12) by means of ball bearings (15) in the vertical direction. At the each rudder part, there are two plates (12) that are superimposed in a way that there will be a certain distance between them. The rudder plates (12) are preferably in triangle form and the tapering end of this triangle is in the cruising direction. There are pin movement channels (18) that are located along an edge opposite to the tapering end, wherein the said channels extend in the direction of the bottom edge of the plate (12). Spring connection pins (17) moving inside the said pin movement channels (18) and extending to downwards are located.

Rudder connection springs (16) are connected to the spring connection pins (17), wherein the said springs are connected from one of their ends to the end part of a pivot connection arm (13) on the spring connection point (19). According to a preferred embodiment of the present invention, the springs (16) are gas springs. While the boat (1) makes a straight cruising, there is no tension in the rudder connection springs (16). When the boat maneuvers, one of the springs (16) is pushed, and the other one becomes loose, and therefore they try to keep the rudder (2) in a position facing to the front end of the boat (1). When the force generated after the rudder (2) has been rotated increases up to the adequately high levels, the forces that the rudder connection springs (16) apply cannot resist any more, and in that case the spring connection pins (17) that the springs are connected to can move inside the pin movement channels to the end of the channel.

When the tilting angle of the boat (1) goes down the threshold tilting angle, the telescopic movement of the pivot (8) needs to be terminated. And therefore the signals coming from the inclination sensor is transmitted to the solenoid actuators by means of the control circuit, and the pin (22) is enabled to be pushed forward. When the pin holes (23) of the inner pivot (9) and the outer pivot (10) encounter, the pin (22) is pushed into the holes.

According to one embodiment of the present invention, the mechanism (20) for extending the pivot length can be activated not only when the boat (1) reaches to a certain tilting threshold degree, but also additionally when the boat (1) maneuvers to a direction. Therefore, the control circuit can evaluate the data coming from both the inclination sensor and the rudder together, and activate the related mechanism (20). In such a case, a threshold degree like a tilting threshold degree of the boat (1) can be previously set to the control circuit for the maneuvering angle.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A dual-rudder control mechanism suitable for use in the sailboats (1), comprising an extendable pivot (8) having each end a respective rudder, mechanism (20) for extending the pivot (8) length for rotating the rudders relative to the pivot (8), a control mechanism being responsive to tilting angle of the sailboat (1), wherein the control mechanism activates or deactivates the mechanism (20) for extending the pivot length in response to a threshold tilting angle of the sailboat body, wherein the rudders can be rotated independently from one another when the mechanism (20) is activated, wherein the mechanism (20) for extending the pivot (8) length is a solenoid actuator, and wherein the solenoid actuator comprises a pin (22) penetrating into respective pin hole (23) that are opened in the radial direction to the inner pivots (9) and outer pivots (10) by actuating the solenoid actuator.

2. A dual-rudder control mechanism suitable for use in the sailboats (1), comprising an extendable pivot (8) having each end a respective rudder, mechanism (20) for extending the pivot (8) length for rotating the rudders relative to the pivot (8), and a control mechanism being responsive to tilting angle of the sailboat (1), wherein the control mechanism activates or deactivates the mechanism (20) for extending the pivot length in response to a threshold angle of the sailboat body, wherein the rudders can be rotated independently from one another when the mechanism (20) is activated, wherein each rudder (2) comprises pivot connection arms (13) connected to end parts of the pivot (8) radially by means of spherical bearings (11) in order for the rudder to be connected to the pivot (8), and rudder connection arm (14) connected to each pivot connection arm (13) and there from extending downwards, wherein each rudder connection arm (14) comprises rudder plates (12) borne in a vertical direction by means of ball bearings (15), wherein the rudder plates (12) has a triangle form with a tapering end thereof is in cruising direction, and the rudder plates comprises pin movement channels (18) located along an edge opposite to the tapering end of the rudder plates (12) and spring connection pins (17) movable inside the pin movement channels (18) and the spring connection pins (17) being extendable in vertical direction.

3. A dual-rudder control mechanism according to claim 2, further comprises rudder connection springs (16) connected from one end to the respective spring connection pin (17), and connected from other end to the pivot connection arm (13).

4. A dual-rudder control mechanism suitable for use in the sailboats (1), comprising an extendable pivot (8) having each end a respective rudder, mechanism (20) for extending the pivot (8) length for rotating the rudders relative to the pivot (8), and a control mechanism being responsive to tilting angle and maneuvering of the sailboat (1), wherein the control mechanism activates or deactivates the mechanism (20) for extending the pivot length in response to a threshold tilting angle of the sailboat body, wherein the rudders can be rotated independently from one another when the mechanism (20) is activated and wherein the solenoid actuator comprises a pin (22) penetrating into respective pin hole (23) that are opened in the radial direction to the inner pivots (9) and outer pivots (10) by actuating the solenoid actuator.

* * * * *